US005857868A

United States Patent [19]

Findon et al.

[11] Patent Number: 5,857,868

[45] Date of Patent: Jan. 12, 1999

[54] COAXIAL TERMINATOR ASSEMBLY

[75] Inventors: Michael K. Findon, Columbus; Jeffrey Steven Saley, Westerville, both of Ohio

[73] Assignee: Universal Recovery Systems, Inc., Columbus, Ohio

[21] Appl. No.: 900,003

[22] Filed: Jul. 24, 1997

Related U.S. Application Data

[60] Provisional application No. 60/022,584 Jul. 24, 1996.

[51] Int. Cl.[6] ..... H01R 13/62

[52] U.S. Cl. ..... 439/310

[58] Field of Search ..... 439/159, 160, 439/310, 910, 923, 488, 489, 259

[56] References Cited

U.S. PATENT DOCUMENTS 4,851,612 7/1989 Peckham ..... 439/136

5,586,900 12/1996 Yagi et al. ..... 439/310

*Primary Examiner*—Neil Abrams
*Assistant Examiner*—Yong Ki Kim
*Attorney, Agent, or Firm*—Thompson Hine & Flory LLP

[57] ABSTRACT

A coaxial cable terminator assembly for coupling a first coaxial cable terminating in a first end and a second coaxial cable terminating in a second end. The assembly comprises a shelf for receiving the first coaxial cable, and a shaft for receiving the second coaxial cable. The shaft is reciprocatingly slidable from a disengaged position wherein the first and second ends are separated, to an engaged position wherein the first and second ends are in contact. The assembly further includes a housing encompassing the shelf, shaft, and ends, and locking means for retaining the shaft in the disengaged position to prevent tampering with the cable ends. The shaft has an extension portion which extends below the housing when the ends are in the engaged or disengaged position to thereby indicate whether the ends are in the engaged or disengaged position.

9 Claims, 2 Drawing Sheets

COAXIAL TERMINATOR ASSEMBLY

This application claims priority of U.S. Provisional Application No. 60/022,584 filed Jul. 24, 1996.

The present invention is directed to a coaxial cable terminator assembly, and more particularly, to a coaxial cable terminator assembly which provides for the coupling and uncoupling of two cables in a tamper-resistant housing.

BACKGROUND OF THE INVENTION

Cable transmission systems for the transfer of signals between devices are well known. Common cable antenna television (CATV) systems in which coaxial cable provides signal communication between a central antenna and remotely located receiver sets is one such example. In a commercial system, access to the signal is obtained by paid subscription. Conventional systems include a permanently installed cable extending from the antenna throughout the area to be served. A plurality of devices, such as directional taps, are spaced along the cable, and each individual subscriber is served by a drop line. The connection between the central system and the subscriber is usually located on an elevated pole which limits access to the connection by the public to reduce the possibility of tampering with the connections.

However, having the connection located in a position difficult to reach for the public also causes difficulty to the cable technician when work is required on the connection. Special equipment, such as lifts, ladders, or climbing equipment must be used by the technician to access the connection. Many other utility connections, such as water and electric connections, can be serviced by accessing a housing located on the exterior of a building. It is desired to provide the same services and advantages in cable antenna television connections. This would allow cable technicians to provide quicker, cheaper, and safer services.

SUMMARY OF THE INVENTION

Accordingly, it is an object of the present invention to provide for a tamper resistant coaxial cable housing. By providing tamper resistant housing, the connection may be placed on ground level, which allows for easier access and servicing by the cable technician. The tamper resistant attributes of the present invention reduce the possibility of tampering by the subscriber or other users. In this manner, the cable provider can provide easy access for its employees.

More particularly, the present invention provides for a coaxial cable terminator assembly for coupling a first coaxial cable terminating in a first end and a second coaxial cable terminating in a second end. The assembly comprises a shelf for receiving the first coaxial cable, and a shaft for receiving the second coaxial cable. The shaft is reciprocatingly slidable from a disengaged position wherein the first and second ends are separated, to an engaged position wherein the first and second ends are in contact. The assembly further includes a housing encompassing the shelf, shaft, and ends, and locking means for retaining the shaft in the disengaged position to prevent tampering with the cable ends. The shaft has an extension portion which extends below the housing when the ends are in the engaged or disengaged position to thereby indicate whether the ends are in the engaged or disengaged position.

These and other objects and advantages of the present invention will be more fully understood and appreciated by reference to the following description, the accompanying drawings and the appended claims.

DETAILED DESCRIPTION

Figure 1:
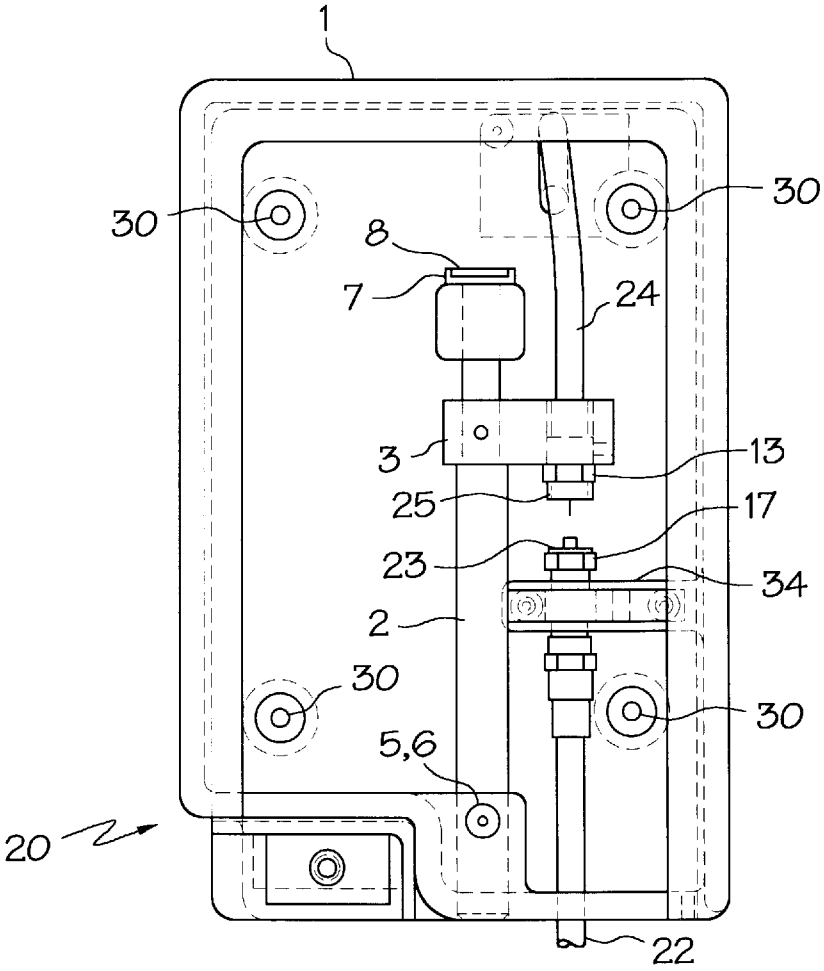
FIG. 1 is a front view of the coaxial cable terminator assembly of the present invention shown without the front panel and in the disengaged position.

FIG. 1 shows a preferred embodiment of the coaxial cable terminator assembly of the present invention, generally designated 20. The assembly receives an incoming coaxial cable 22 and an outgoing coaxial cable 24. The outgoing cable 24 is coupled to the reciprocable shaft 2. The shaft 2 may move from the disengaged position, as shown in FIG. 1, to the engaged position shown in FIG. 4. In the engaged position, the incoming cable 22 and the outgoing cable 24 may be coupled, thereby providing data communications service to the subscriber. When in the disengaged position (FIG. 1) various securing means are used to secure the shaft in the disengaged position to resist tampering efforts by the subscriber or others to move the shaft 2 to the engaged position.

The assembly 20 of the present invention preferably includes a housing 1. The housing may be fabricated from any suitable material, and, in particular, in impact resistant plastic. The housing 1 may be of various colors to match the exterior of the building of which it may be attached. The incoming coaxial cable 22 is connected to the central antenna system, and the outgoing cable 24 enters the adjacent building and is used by the subscriber to receive signals from the central antenna. The outgoing cable 24 terminates in outgoing cable end 25, and the incoming cable 22 terminates in incoming cable end 23. Outgoing connector 13 caps the cable end 25, and incoming connector 17 caps the incoming end 23. In a preferred embodiment, the outgoing cable 24 is carried in a yoke, or connector holder, 3 which is mounted to the reciprocable shaft 2. Shelf 34 retains the incoming cable 22, and is secured to the housing 1. The connector 17 is preferably secured to the connector holder 3 using an epoxy adhesive or similar high-strength adhesive.

Figure 4:
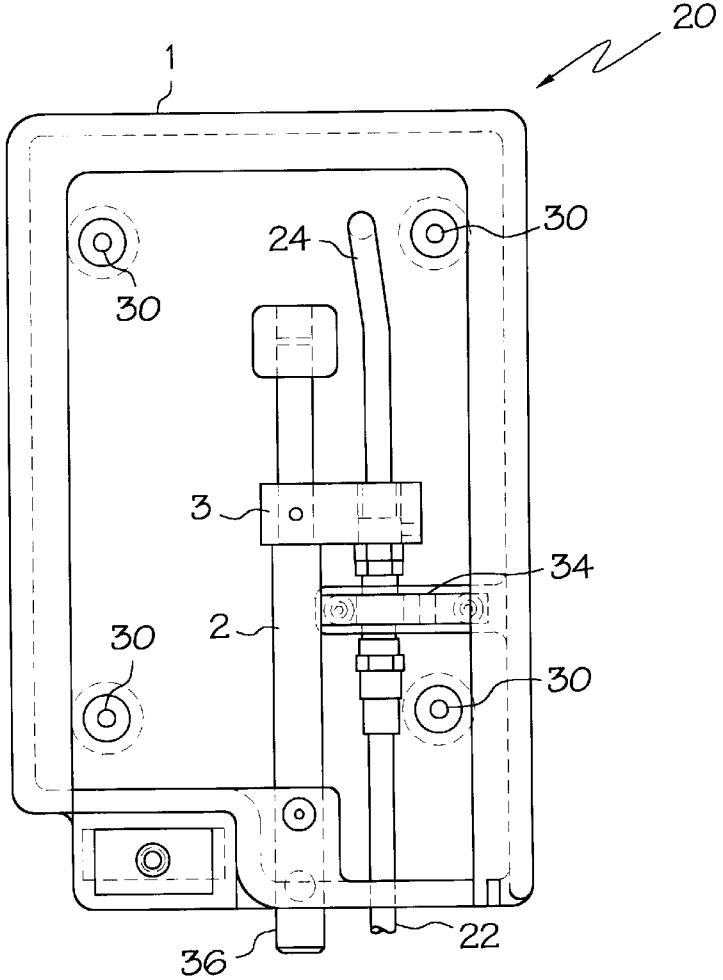
FIG. 4 is a front view of the assembly of FIG. 1 shown in the engaged position.

In the illustrated embodiment, the shaft 2 extends below the housing 1 when in the engaged position, as shown in FIG. 4. Extension portion 36 of the shaft 2 extends below the housing 1 when the shaft 2 is in the engaged position. In this manner, the cable technician can ascertain that the cable is in the engaged position when the extension portion 36 is extending below the housing 1.

When in the engaged position, the incoming connector 17 mates with the outgoing connector 13. Threaded screws on one connector, and a associated threaded nut on the other connector, allows the cables 22, 24 to be coupled together when the shaft 2 is in the engaged position.

In order to prevent tampering with the connection, the shaft 2 may be locked into its disengaged position. In the embodiment illustrated, two locking means are provided. One locking means is a spring-loaded detente 5 which slides into a cavity in the shaft 2 when the shaft is in the disengaged position. The second locking means is a retainer ring 8 which snaps into a retainer ring guard 7 mounted on one end of the shaft 2. In the illustrated embodiment, service is disengaged by sliding shaft 2 upwardly to uncouple the incoming cable 22 from the outgoing cable 24. When the shaft reaches the disengaged position, the ball detente 5 slides into the recess located in the shaft 2. Furthermore, the retaining ring 8 can be snapped over the top of the shaft 2 into the retaining ring guard 7. The retaining ring guard 7 serves to further prevent tampering by somewhat hiding the existence of the retainer ring 8. To reconnect service and move the shaft 2 into the engaged position, the retaining ring 8 is removed and the ball detente 5 is compressed by inserting a pin into a small aperture 6 in the shaft 2 so as to press the ball detente 5 out of the recess. The aperture 6 in the shaft through which the ball detente 5 is pressed can be camouflaged by a misleading label such as "oil".

Those skilled in the art will immediately recognize alternative embodiments are possible wherein the incoming cable 22 is carried on the shaft 2 and the outgoing cable is mounted to a fixed block 34. In this embodiment, the shaft 2 extends below the housing 1 when the assembly is in the disengaged position. When in the engaged position, the shaft 2 is in a raised position.

Figure 2:
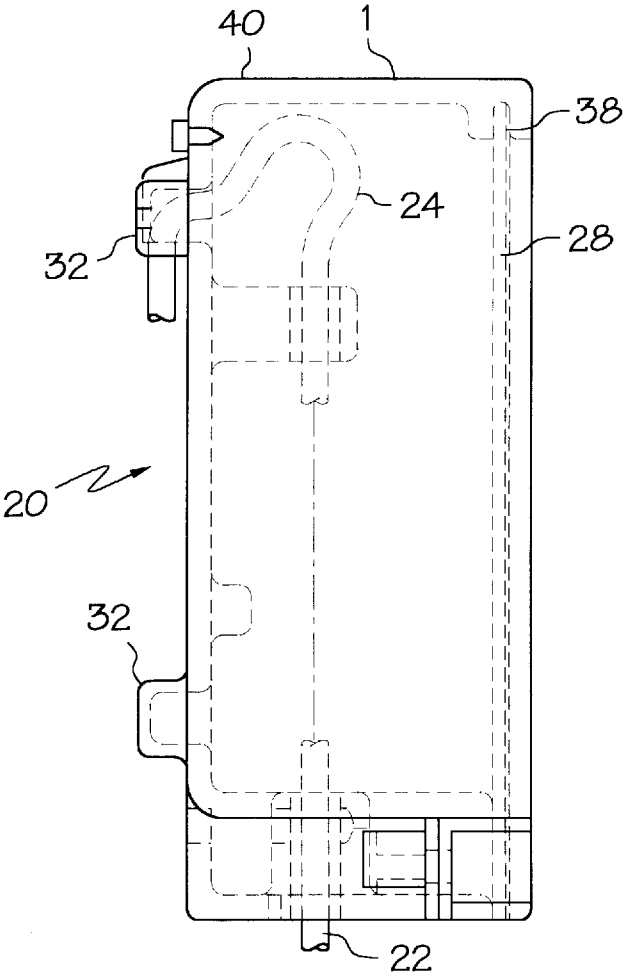
FIG. 2 is a side view of the assembly of FIG. 1.
Figure 3:
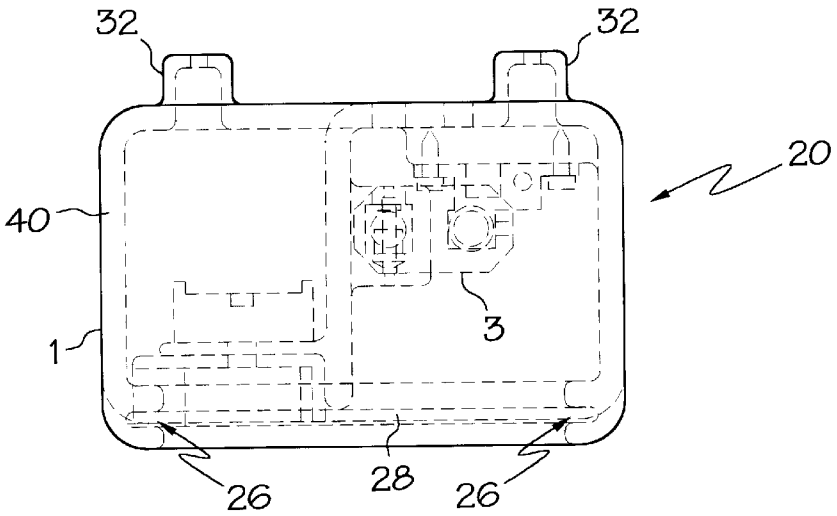
FIG. 3 is a top view of the assembly of FIG. 1.

As shown in FIG. 3, the housing 1 includes a molding 40 which is generally U-shaped in top view, with each prong of the "U" terminating in a pair of slots 26. The slots 26 receive a front panel 28 to thereby encase the elements of the assembly 20. Groove 38 (FIG. 2) along the top of the molding 40 receives and retains the front panel 28. The molding 40 is mounted to a support surface, such as an exterior wall of a building, by means of screws or other attachment means passed through the holes 30. The holes 30 are contained within a set of bosses 32.

In order to secure the housing, a "Budco" tamper evident tag, such as supplied under the trade name TAPLOCK, can be provided through an aperture in the cover and box, or through an aperture in a portion of the shaft which extends from the box. The tamper evident tag may be stamped with a unique identification number. Thus, when the tag is missing, or the identification code of the tag does not match that of the cable supplier's records, the cable supplier may thereby be alerted that the box may have been tampered with. As a further security means, the housing may be enclosed by an additional locking means, such as a MORLOCK passed through apertures in the housing 1.

In yet another alternate embodiment, a window (not shown) of transparent material, may be located in the front panel 28. The window allows the cable technician to visually verify whether the assembly is in the engaged or disengaged position, and provides yet another method to detect tampering with the assembly 20.

In an alternate embodiment, the outgoing cable 24, the shaft 2, the shelf 34, and the incoming cable 22 are all mounted on a plate (not shown). The plate is a generally rectangular and can be made of various materials, including hardened plastic. The plate may be attached to the building or other structure. After the cable technician has serviced the assembly and it is desired to enclose the assembly 20, a generally U-shaped in top view cover, having a pair of slots to receive the plate, may be slid over the mounted plate. The various security means discussed above, including a MORLOCK and a tamper-evident tag, may then be used to secure the cover to the plate. Under this alternate embodiment, servicing the assembly, such as connecting or disconnecting the cables, is easier for the technician. Accessing the various components is facilitated because there are no walls surrounding the components of the assembly in which the worker must squeeze their hands. The alternate embodiment may also provide for a window in the cover to allow for visual inspection of the connection.

While the forms of apparatus herein described constitute a preferred embodiment of the invention, it is to be understood that the present invention is not limited to these precise forms and that changes may be made therein without departing from the scope of the invention.

What is claimed is:

1. A coaxial cable terminator assembly for coupling a first coaxial cable terminating in a first end and a second coaxial cable terminating in a second end, the assembly comprising:

a shelf for receiving said first coaxial cable;

a shaft for receiving said second coaxial cable, said shaft being reciprocatingly slidable from a disengaged position wherein said first and second ends are separated, to an engaged position wherein said first and second ends are in contact;

a housing encompassing said shelf, shaft, and ends; and locking means for retaining said shaft in said disengaged position to prevent tampering with said cable ends;

wherein said shaft has an extension portion which extends below said housing when said ends are in the engaged or disengaged position to thereby indicate whether said ends are in the engaged or disengaged position.

2. The assembly of claim 1 wherein said assembly further includes a block mounted to said shaft and receiving said second coaxial cable to thereby couple said second cable to said shaft.

3. The assembly of claim 2 wherein said locking means includes a receiving notch located in said shaft and a spring biased detent ball, whereby said ball is located so as to engage said notch when said shaft is in said disengaged position to thereby retain said shaft in said disengaged position.

4. The assembly of claim 3 wherein said locking means further includes a locking ring mounted to said housing and a retainer ring mounted to said shaft to receive said locking ring and thereby retain said shaft in said disengaged position.

5. The assembly of claim 4 wherein said housing includes a generally transparent window shaped and located to allow visual confirmation of the status of said cable ends.

6. The assembly of claim 5 wherein said shaft is movable from an upper, disengaged position to a lower engaged position, whereby said shaft extension portion extends below said housing when said cable ends are in contact.

7. The assembly of claim 6 wherein said shelf is mounted to said housing.

8. The assembly of claim 7 wherein said housing includes a plate being attachable to a support wall and a cover being generally U-shaped in top view and having a pair of opposed slots to receive said plate, said cover being slidably received by said plate such that said housing thereby encompasses said shaft, block, shelf, and cable ends.

9. The assembly of claim 7 wherein said housing includes a molding being generally U-shaped in top view and attachable to a support wall and having a pair of opposed slots, said housing further including a front panel being shaped so as to be received in said slots to thereby encompass said shaft, block, shelf, and cable ends.

* * * * *